United States Patent [19]

Davenport

[11] 4,170,746

[45] Oct. 9, 1979

[54] HIGH FREQUENCY OPERATION OF MINIATURE METAL VAPOR DISCHARGE LAMPS

[75] Inventor: John M. Davenport, Lyndhurst, Ohio

[73] Assignee: General Electric Company, Schenectady, N.Y.

[21] Appl. No.: 864,578

[22] Filed: Dec. 27, 1977

[51] Int. Cl.[2] ..... H05B 41/16; H05B 41/24

[52] U.S. Cl. ..... 315/246; 315/326; 315/DIG. 7

[58] Field of Search ..... 315/209 R, 219, 246 R, 315/326, DIG. 7

[56] References Cited

U.S. PATENT DOCUMENTS 4,052,636 10/1977 Strok ..... 313/217

OTHER PUBLICATIONS

Witting, "Acoustic Resonances in Cylindrical Hi-Pressure Arc Discharges," Journal of Applied Physics, Apr. 1978.

*Primary Examiner*—Eugene R. La Roche
*Assistant Examiner*—Robert E. Wise
*Attorney, Agent, or Firm*—Ernest W. Legree; Lawrence R. Kempton; Frank L. Neuhauser

[57] ABSTRACT

Miniature high pressure metal vapor lamps containing mercury in a discharge volume of one cubic centimeter or less when operated at low frequencies have extremely high reignition voltages; the problem is compounded in metal halide lamps, particularly during warm-up. Ballast designs capable of coping with these conditions at 60 Hz have disadvantages. The discovery of the existence of resonance-free regions in the frequency range between 20 and 50 KHz has made stable and efficient lamp performance possible through the use of compact, practical and economical high frequency ballasts.

18 Claims, 10 Drawing Figures

VOLT-AMPHERE CHARACTERISTICS
60 Hz

REIGNITION VOLTAGE RATIO, $N_R$, STEADY STATE

REIGNITION VOLTAGE, $V_R$, DURING WARM-UP

ACOUSTIC RESONANCE BANDS IN MINIATURE DISCHARGE LAMPS

RESONANCE SPECTRA AS A FUNCTION OF MERCURY DENSITY

HIGH FREQUENCY OPERATION OF MINIATURE METAL VAPOR DISCHARGE LAMPS

The invention relates to high frequency operation of high pressure metal vapor discharge lamps having very small discharge volumes starting at about one cubic centimeter and going down to a fraction of a cubic centimeter, and preferably including metal halide.

BACKGROUND OF THE INVENTION

In copending application Ser. No. 912,268, filed June 5, 1978 by Daniel M. Cap and William H. Lake, titled High Pressure Metal Vapor Discharge Lamps of Improved Efficacy, which is a continuation-in-part of an earlier application Ser. No. 812,479, filed July 5, 1977 similarly assigned, useful and efficient high pressure discharge lamps are disclosed having much smaller sizes than have been considered practical heretofore, namely discharge volumes of one cubic centimeter or less. In preferred form achieving maximum efficacy, these high intensity lamps utilize generally spheroidal thin-walled arc chambers which may vary in shape from slightly oblate to substantially prolate. Remarkably high efficacies are obtained by raising the metal vapor pressure above 5 atmospheres and to progressively higher pressures as the size is reduced. In such miniature lamps, the convective arc instability usually associated with the high pressures utilized is avoided, and there is no appreciable hazard from possibility of explosion. Practical designs provide wattage ratings or lamp sizes starting at about 100 watts and going down to less than 10 watts, the lamps having characteristics including color rendition, efficacy, maintenance and life duration making them suitable for general lighting purposes.

A less desirable characteristic of these miniature high pressure metal vapor lamps is the very rapid deionization to which they are subject. In operation on 60 Hz alternating current, deionization is almost complete between half cycles so that a very high restriking voltage is required to be provided by the ballast. Particularly in metal halide lamps, during lamp warm-up within the first few seconds after arc ignition, the reignition voltage reaches extremely high levels. In view of these deionization limitations associated with low frequency operation of miniature metal halide lamps, the use of conventional 60 Hz ballasts has many disadvantages.

The object of the invention is to provide an improved method or operating system for miniature metal halide lamps which overcomes the limitations imposed by rapid deionization at low operating frequencies and which permits the design of compact, practical and efficient high frequency ballasts.

SUMMARY OF THE INVENTION

In general, when commercially available metal halide lamps are operated at frequencies in the range of 20 to 50 kilohertz, they are subject to destructive acoustic resonances. My invention is predicated on the discovery that miniature lamps of the present kind have resonance-free regions occurring when the lamp current is in the frequency range of about 20 to 50 KHz. In these regions stable operation is possible. The lamps have resonance bands in which three levels of resonant effects may be defined:

1. Catastrophic instability in which the arc is forced to the wall and will quickly melt through the quartz;
2. Arc instability in which the light output fluctuates and the arc wanders;
3. Aureole instability in which the luminous aureole surrounding the arc is unstable.

The most useful resonance-free regions are located between the first and second catastrophic instability bands and also immediately below the first catastrophic band in the case of lamps of less than 6 mm internal diameter or less. Also, relatively narrow bands of arc instability and aureole instability within these regions should be avoided. By thus choosing operating frequencies within these regions, and preferably within selected design windows, stable and efficient lamp performance may be achieved by means of practical and economical high frequency ballasts.

DETAILED DESCRIPTION

Deionization Characteristics

Figure 5:
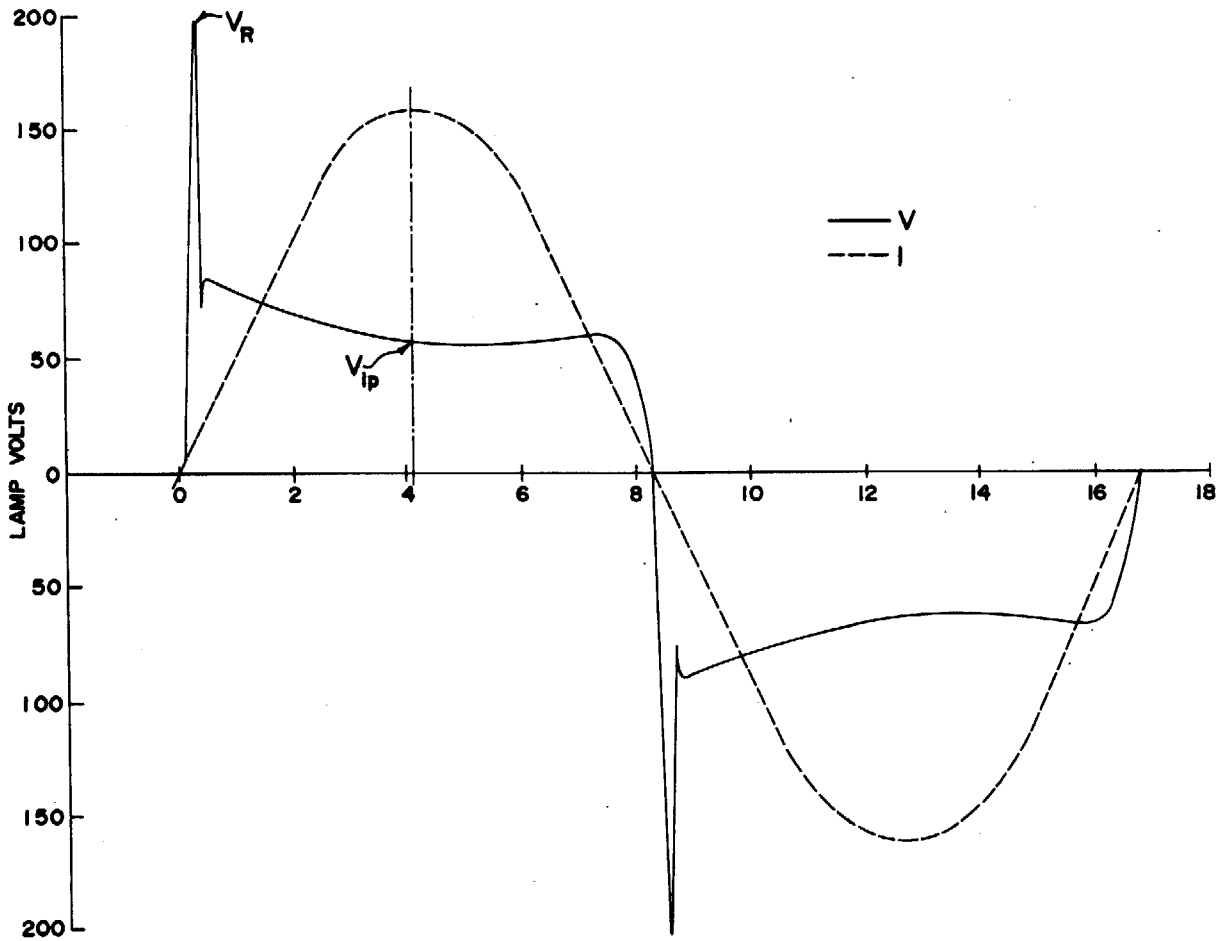
FIG. 5 illustrates a typical volt ampere characteristic of a miniature metal halide lamp at 60 Hz showing the reignition voltage peak.

The dominant electrical parameter affecting the low frequency operation of miniature high pressure metal vapor lamps and particularly metal halide lamps is the presence of a substantial reignition voltage during warm-up and operation. The voltage rise occurs after the zero crossing of the current at the end of each half cycle. A typical pattern is shown in FIG. 5 which is an oscilloscope trace of the voltage (solid line) across and the current (dotted line) through an arc tube operating at 60 Hz from a sinusoidal source. The reignition voltage ratio $N_R$ may be defined $N_R = V_R/V_{Ip}$, where $V_R$ is the peak reignition voltage, and $V_{Ip}$ is the voltage across the lamp at the instant of current peak. In FIG. 5, the reignition voltage ratio $N_R$ is approximately 3.3.

The voltage rise at reignition occurs as a result of an increase in the plasma impedance during the time the current is near zero. In a high pressure discharge, the impedance of the arc is governed by the electron and ion densities and these vary exponentially with the gas temperature at the core of the arc. Cooling of the arc by conduction to the walls is of prime importance and the rate of cooling varies inversely with arc tube diameter. This is demonstrated in FIG. 6 which shows the reignition voltage ratio as a function of frequency for two bulb sizes, a 3.2 mm inner diameter sphere having an o.d. of approximately 4.2 mm and a 7.0 mm i.d. sphere.

A presently favored bulb size has an inner diameter of approximately 6 mm and for it the voltage reignition ratio $N_R$ is approximately 2.0 at 60 Hz. This is a large ratio but not unsurmountable in 60 Hz ballast design.

Reignition During Warm-Up

Figure 6:
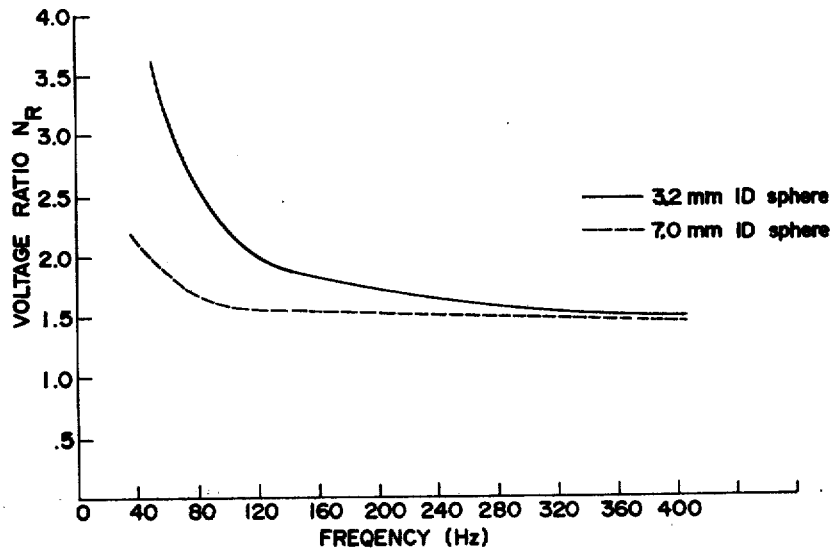
FIG. 6 is a graph showing the reignition voltage ratio as a function of frequency for two bulb sizes.
Figure 7:
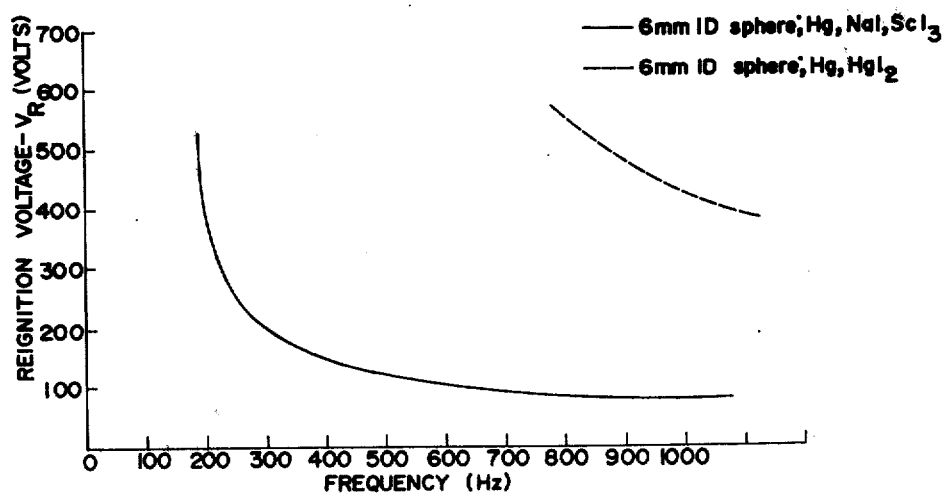
FIG. 7 is a graph showing the reignition voltage ratio during warm-up as a function of frequency.

The really serious problem with 60 Hz operation of miniature metal halide lamps occurs during warm-up of the arc tube. A dramatic increase in reignition voltage occurs a few seconds after arc ignition. After this time the reignition peak decreases in size as the arc tube temperature continues to rise and the vapor pressure to increase, dropping to the final or steady state value for any given frequency as shown in FIG. 6. The peak reignition voltage $V_R$ during warm-up is shown as a function of frequency in FIG. 7 for two arc tubes of the same size and shape, 6 mm inner diameter and spherical. As indicated, one contained a filling of mercury plus sodium, scandium and thorium iodides corresponding in kind to the fill used in commercial metal halide lamps, and the other contained a fill of mercury and mercury iodide. In the case of the mercury iodide lamp particularly, the large reignition voltages even at ten times line frequency will be noted. The reignition voltage for this lamp exceeds 800 volts at 600 Hz, while for the other lamp containing Na-Sc-Th, the 800 volt peak was exceeded between 60 and 100 Hz.

The high reignition voltage during warm-up is believed to be due to a rapid increase in the rate of loss of electrons by attachment to the halogen atoms or molecules in the gas phase before the gas temperature has increased to that encountered in the high pressure arc. This problem occurs in conventional lamps as well and has been discussed in the literature; see J. F. Waymouth, Electric Discharge lamps, M.I.T. Press, 1971, chap. 10. The gas phase halogens would come from condensed mercury iodide which has a much higher vapor pressure than that of the other halides, comparable to that of mercury itself. Thus, the electron decay rate is proportional to the number of iodine atoms or molecules present in the gas (or vapor). The reignition voltage depends on the number of electrons left after a given time and is inversely proportional to frequency. The attachment process ceases to be of primary importance under normal operation conditions since the electron production and loss mechanism depends only on the arc core temperature which is relatively independent of iodine content. Also, the free iodine content obtained from mercury iodide vapor saturates at wall temperatures much below operation conditions. These views have been experimentally confirmed by the observation that high reignition voltage corresponding to warm-up may be maintained indefinitely by blowing a stream of cool air on an operating arc tube. This prevents full evaporation of the mercury so that the high gas temperature discharge condition is never attained.

Ballasting Limitations

The presence of the substantial reignition peak during warm-up of small metal halide lamps operated at low frequencies is not easily overcome because of the inevitable presence of contaminants such as water vapor which liberate halogen atoms within the lamp through halide reaction mechanisms. Practical high frequency ballasts which overcome the reignition problem must make use of solid state control devices such as transistors in conjunction with ferrite cores. Below 20 KHz, ferrite core size increases to the point where the feasibility of a compact ballast is questionable. Also, noise or sound level becomes a problem because the magnetostrictive vibrations originating from the flux variations in the ferrite material are either within the auditory range or on its threshold. When these considerations are joined, the result is to limit practical high frequency ballast design to operation above the auditory range. Above 50 KHz, the limits of practical transistor switching speeds for high efficiency operation are approached and ballast losses begin to increase inordinately. Also, electromagnetic interference, that is, radio and television interference from the lamp and associated circuitry begins to be a serious problem.

Acoustic Resonance

The occurrence of destructive acoustic resonances in commercially available metal halide lamps, as well as in other high intensity lamps such as sodium and mercury lamps, is well known. The state of knowledge in this area prior to my invention may be summarized as follows:

1. Acoustic vibrations occur in lamps at the power frequency of the source which is twice the line or current frequency. These vibrations are propagated as gas density waves and hence by definition are acoustic disturbances, or ultrasonic if above 20 KHz.
2. Ordinary commercially available metal halide lamps cannot be operated between 20 KHz and 50 KHz on account of resonance effects.
3. As little as 10% high frequency modulation in the envelope or waveform of any current may be sufficient to introduce acoustic resonance.

Resonance-Free Region in Miniature Lamps

A simple theoretical model using a velocity of sound averaged for temperature and for gas species to calculate the resonant mode of the gas contained in a lamp envelope could not be used to predict either the frequency of occurrence or the frequency width of the acoustic resonances observed in measurements on commercially available metal halide lamps. However, during investigation of a spheroidal arc tube having an outer diameter of 9 mm and an actual length of 10 mm, I found that with an input of 80 watts, stable operation occurred at 20 KHz with a band width of the resonance-free region of about 100 Hz. I reasoned that a smaller lamp size and a more spherical shape of the envelope would raise the frequency of the resonance-free band and also widen it. This opened the possibility of finding a resonance-free stable region between 20 and 50 KHz for all sizes of miniature metal halide lamps, that is lamps less than 1 cubic centimeter in discharge chamber volume. Subsequent lamps were made smaller and more spherical. Using a blocking oscillator ballast such as that described hereinafter, I found stable operation for a spherical lamp of 6 mm outer diameter having an inner diameter of about 5 mm. For this lamp the resonance-free region was centered about 33 KHz and was about 10 KHz wide.

Absence of Predictive Model

It is possible to list some of the essential features that a model would need to have in order to predict the occurrence and frequency width of acoustic resonances in miniature metal halide lamps. The arc chamber geometry must be taken into account, both from the point of view of the driving force which is the arc, and the boundary conditions at the wall. For a plane wave, the velocity could vary by a factor greater than 2 on account of the temperature gradients encountered in a lamp: therefore, they must be taken into account together with the possibility of non-linearity due to gas mixing. The absolute gas density is a factor since the amplitude of a wave reflection caused by the change in density at a boundary depends upon the ratio of the acoustic impedance through the gas-vapor medium and that of the boundary material. Finally, the effect of "stiffness" of the arc must be allowed for, as well as the effects of turbulence and convection. On account of the complexity of a satisfactory theoretical model, I have approached the problem experimentally.

Instability Bands

I have investigated the acoustic resonance spectra of miniature metal halide lamps as a function of bulb diameter, mercury density and electrode spacing, concentrating on bulbs of spheroidal shape, that is bulbs of spherical shape as shown in FIGS. 1 to 4, or near spherical shape. Measurements were made over a frequency range starting with unidirectional current and going up to 250 KHz with emphasis on the 20 to 50 KHz region. The a.c. measurements were made using a sinusoidal source and series inductance to limit current through the lamps.

Figure 1:
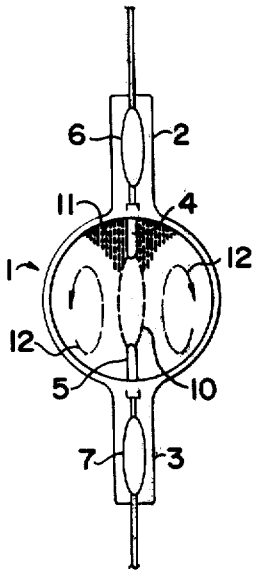
FIGS. 1 to 4 illustrate arc tubes of miniature metal halide discharge lamps, the first operating with a stable arc and the others illustrating various forms of acoustic instability.
Figure 3:
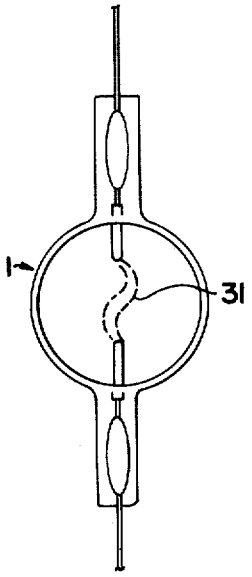
Figure 2:
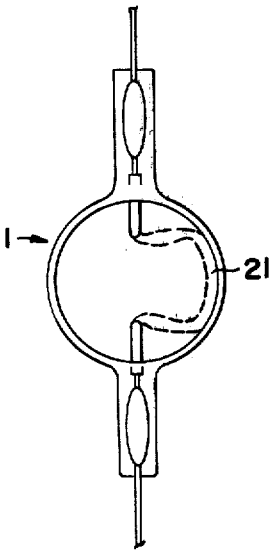

Referring to FIG. 1, arc tube 1 is typical of the inner discharge envelope of a miniature metal halide lamp. It is made of quartz or fused silica, suitably by the expansion and upset of quartz tubing while heated to plasticity. The neck portions 2,3 may be formed by allowing the quartz tubing to neck down through surface tension. In the illustrated example, the wall thickness is about 0.5 mm so that the internal diameter is about 6 mm and the envelope volume is approximately 0.11 cc. Pin-like electrodes, 4,5 of tungsten are positioned on the axis of the envelope with their distal ends defining an interelectrode arc gap of 3 mm in this example. The pins are joined to foliated molybdenum inleads 6,7, preferably by a laser weld at a butt joint. The electrode pin-inlead assemblies and the method of making them are more fully described in copending application Ser. No. 824,557, filed Aug. 15, 1977 by Richard L. Hansler, entitled "Electrode-Inlead for Miniature Discharge Lamps" and assigned to the same assignee as this application. That application has been abandoned in favor of continuation-in-part application Ser. No. 900,612, filed April 27, 1978, now U.S. Pat. No. 4,136,298. The root end of the tungsten electrodes and the laser weld to the molybdenum inleads are embedded in the fused silica and this assures adequate rigidity notwithstanding the paper-thin portions in the molybdenum inleads. In the process of sealing in the electrodes, the foliated portions are wetted by the fused silica of the necks 2,3 and this assures hermetic seals.

By way of example, a suitable filling for a lamp of this size having a rating of about 30 watts comprises argon at a pressure of 100 to 120 torr, 4.3 mg of Hg, and 2.2 mg of halide salt consisting of 85% NaI, 5% $ScI_3$ and 10% $ThI_4$ by weight. Such quantity of Hg, when totally vaporized under operating conditions, will provide a density of 39.4 mg/cm$^3$ which corresponds to a pressure of about 23 atmospheres.

Figure 8:
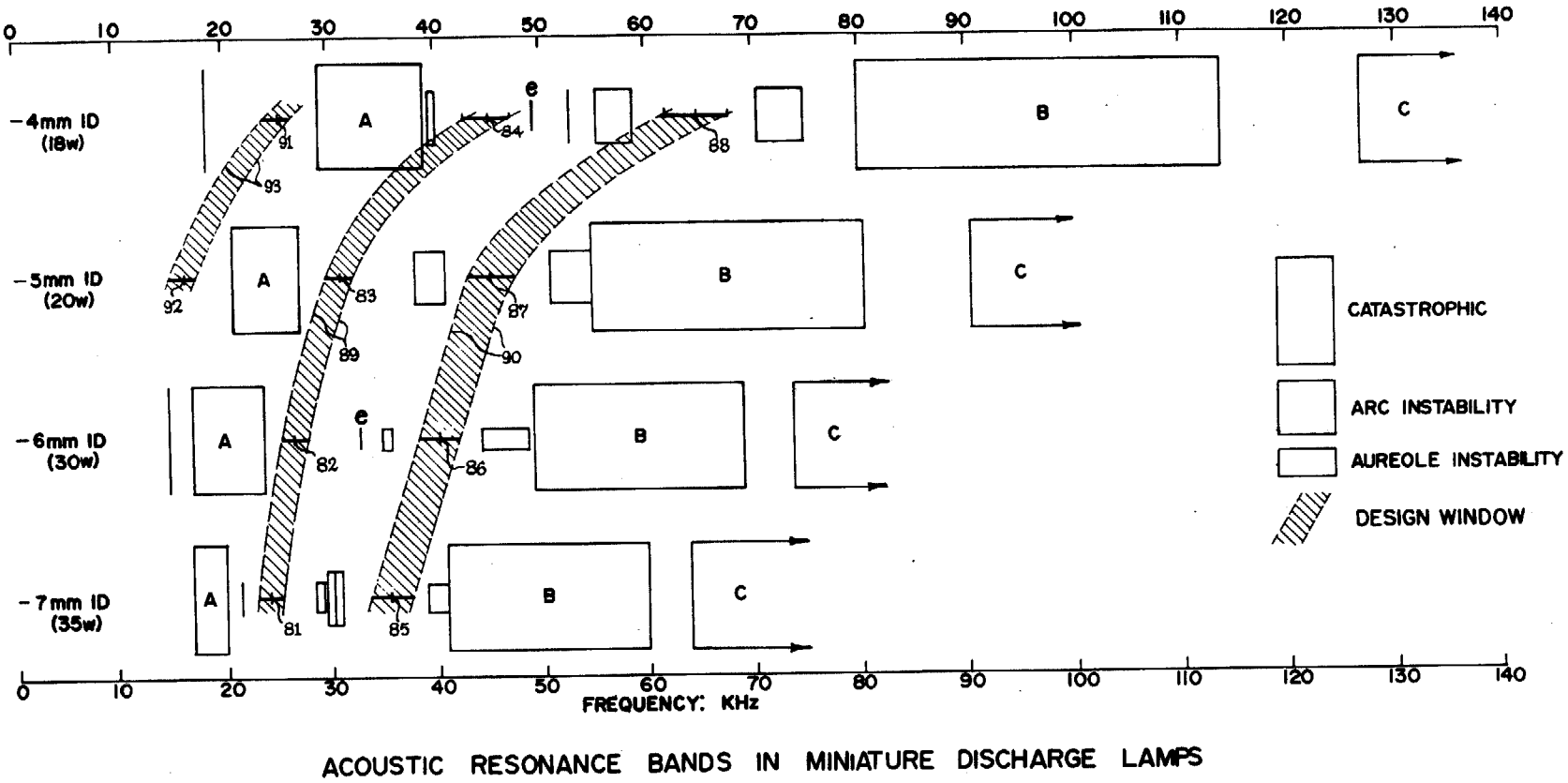
FIG. 8 is a chart showing acoustic resonance bands and stable windows for various diameters of miniature spheroidal discharge lamps.

FIG. 8 is a bar chart or plot of the resonance spectra of 4 lamps similar to that illustrated in FIG. 1, but having bulb inner diameters of 4, 5, 6 and 7 mm respectively. The electrode gap was kept constant at 3 mm while the filling was adjusted to the envelope volume to achieve the same mercury density in each lamp. Three levels of resonance behavior may be defined:

1. Catastrophic Instability: The arc, which normally extends directly between electrode tips as indicated at 10 in FIG. 1, is forced to the wall as indicated at 21 in FIG. 2. It will melt through the quartz if allowed to continue this way for more than a few seconds. The arc voltage drop increases due to the lengthened arc path and may more than double. This condition is indicated in FIGS. 8 and 9 by a full-height bar extending throughout the frequency range in which it exists.

2. Arc Instability: The arc may wander and move back and forth, sometimes with serpentine shape as illustrated at 31 in FIG. 3. The arc voltage drop fluctuates and the light output also fluctuates considerably. This condition is indicated by a half-height bar.

Figure 4:
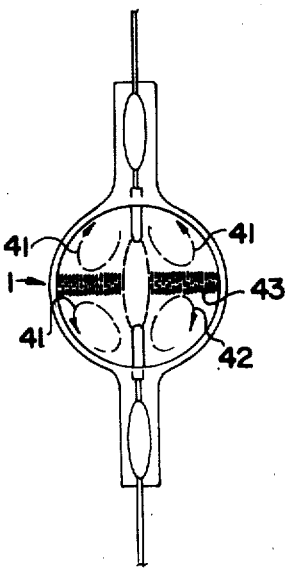

3. Aureole Instability: The aureole is a luminous glow surrounding the arc and normally concentrated about the upper electrode as shown at 11 in FIG. 1. In a sodium-containing lamp it is a reddish glow caused by sodium excitation. In aureole instability, the intense arc extending directly between the electrodes remains stable but the aureole moves about. The light fluctuation is minor and there is no noticeable voltage effect. This is the least destructive form of instability and it is indicated by a quarter-height bar in the charts. An unusual form of aureole instability occurring as an equatorial band 43 in the center of the bulb is illustrated in FIG. 4. It is probably due to a double convection pattern indicated by upper and lower curved arrows 41, 42. This pattern is indicated by a quarter-height bar with the letter e over it.

Figure 9:
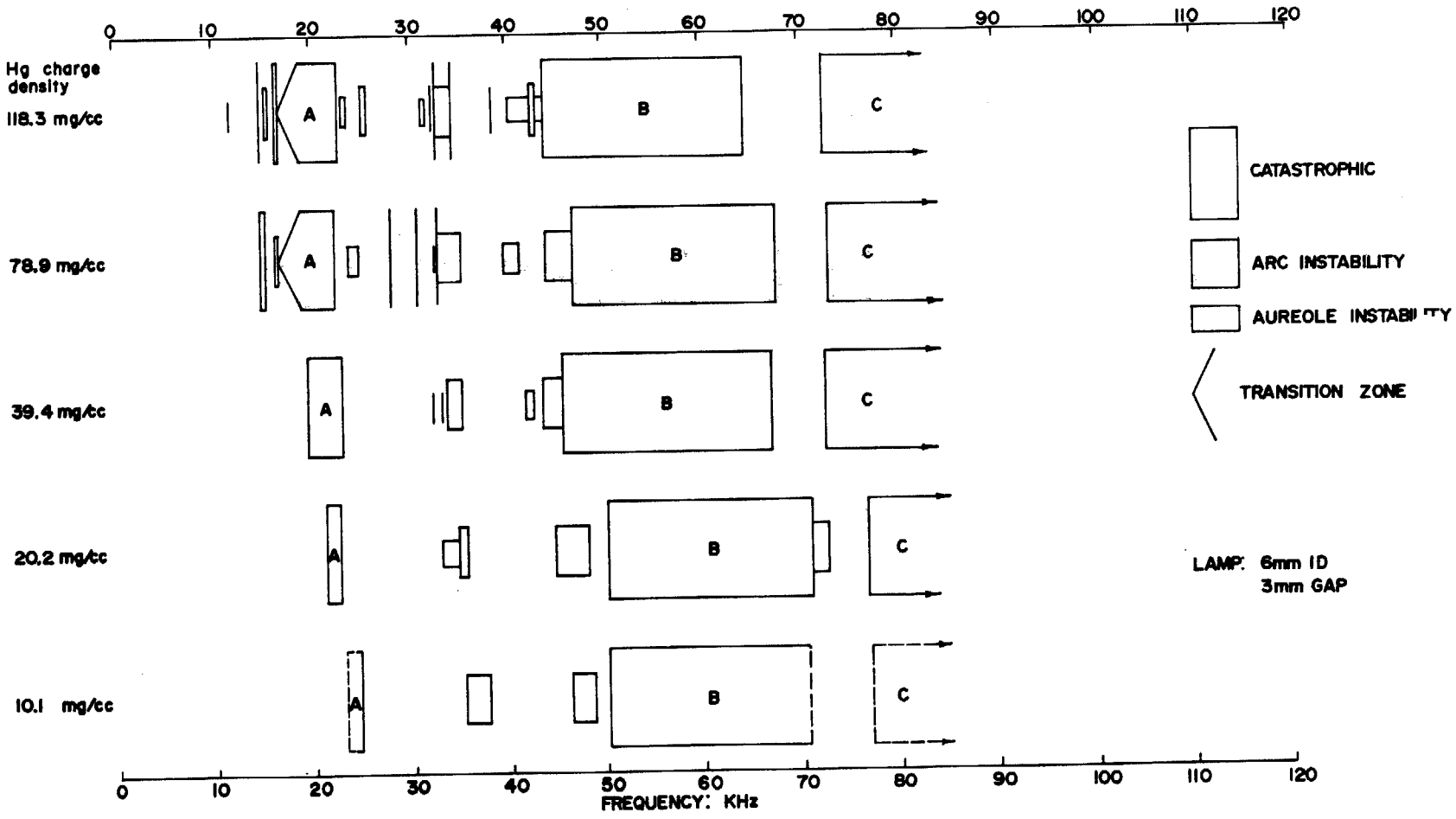
FIG. 9 is a chart showing resonance spectra as a function of mercury density in one size of lamp.

In the resonance spectra charts of FIGS. 8 and 9, the central arc and the aureole are stable in the unmarked frequency regions between the indicated instabilities. These unmarked regions contain the resonance-free operating bands wherein the lamps may be operated stably over their useful lives. The most important feature of the spectra shown in FIG. 8 is the repeat of the pattern with bulb size. Thus, for example, the first occurring catastrophic instability band marked A recurs with each bulb size. The band is compressed and shifted to lower frequencies as the bulb size is increased. The same reiterative pattern is observed with the catastrophic instability band next higher in frequency and marked B, and likewise the succeeding one marked C. The entire spectra including arc instability and aureole instability bands are compressed and shifted in a similar way with all bulb sizes. The data were taken using an essentially sinusoidal waveform power supply. If a non-sinusoidal waveform is used, additional instabilities may appear which may narrow or perturb the resonance-free regions.

Operating Regions and Design Windows

On the basis of the data summarized in FIG. 8 and other related measurements, I have concluded that the most useful high frequency operating regions for miniature high pressure metal vapor lamps, that is lamps having a discharge volume less than 1 cm$^3$, are the resonance-free regions located between the first and second catastrophic instability bands. Thus, for a 7 mm i.d. lamp, one would choose to operate above the A band and below the B band, namely in the range from about 20 to 40 KHz. However, one must avoid the arc instability band extending from about 29 to 31 KHz. Also, it is desirable to avoid the narrow aureole instability bands at 21 KHz, at 28 to 29 KHz, and the wider one at 39 to 41 KHz. In order to take care of manufacturing tolerances, an operating frequency should be chosen as far as possible from instability regions. Thus, the optimal frequencies for the 7 mm i.d. spherical lamp are seen to be approximately 24 KHz and 35 KHz. In designing a ballasting circuit to operate within the 20 to 50 KHz range, in general the low end of the range is preferred for reduced electromagnetic interference and slower transistor switching speed. Accordingly, 24 KHz may be selected as the design frequency and this will permit a manufacturing tolerance of about ±5% in frequency, that is from about 23 to 25 KHz, without any danger of running into instability bands. The preferred design center point and range are indicated by the heavy line 81 in FIG. 8.

In similar fashion for a 6 mm i.d. spheroidal lamp the preferred design center point is 26.5 KHz and the ±5% frequency tolerance range is indicated at 82; for 5 mm i.d., the center point is 31 KHz and the range is indicated at 83. For 4 mm i.d., the design center point is 45 KHz and the range is indicated at 84. If one chooses the upper end of the range, the preferred design center points are 34 KHz for a 7 mm i.d. lamp and the ±5% frequency tolerance range is indicated at 85; 40 KHz for a 6 mm i.d. lamp with the range indicated at 86; 45 KHz for a 5 mm i.d. lamp with the range indicated at 87; and 65 KHz for a 4 mm i.d. lamp with the range indicated at 88. The broken lines 89 for the lower band and 90 for the upper band, joining the ends of the design ranges for the various sizes encompass approximately the preferred ±5% frequency tolerance design windows (shown cross-hatched) for spheroidal lamps of intermediate diameters.

In the case of lamps of less than 6 mm i.d., operating frequencies below the first catastrophic instability band may be chosen. Thus, for a 4 mm i.d. lamp, an operating frequency using a design center point of approximately 25.5 KHz may be chosen, the ±5% frequency tolerance range being indicated at 91. The design center point below the first catastrophic instability band in the case of a 5 mm lamp is approximately 17 KHz and the ±5% range is indicated at 92. The broken lines 93 encompass the preferred ±5% frequency design window for spheroidal lamps having diameters intermediate 4 and 5 mm.

A compression or narrowing of the resonance-free regions, that is, a reduction of the frequency width between bands A and B, occurs as the envelope diameter is increased. This fact also suggests why resonance-free regions have not been observed in the 20 to 50 KHz region prior to my invention. The reason would be that the arc tube diameters of commercially available metal halide lamps (generally not less than 14 mm i.d.) are large enough that the catastrophic regions expand and extend themselves over the entire region from 20 to 50 KHz, leaving no safe stable regions or windows wherein to operate.

The variation of the pattern with mercury vapor density is seen in FIG. 9. Five spherical lamps of 6 mm i.d. and having an electrode gap of 3 mm were given fillings providing mercury densities of about 10, 20, 39, 79 and 118 mg/cc when vaporized. The lamps were operated at constant wall loading. The main features of the spectra persist notwithstanding the variation in mercury density. The positions of the catastrophic instability band shift slightly to lower frequencies as the vapor pressure is increased. Thus, the upper edge of the A band drops from 25 to 23 KHz, while the lower edge of the B band drops from 50 to 43 KHz in going from 10 to 118 mg/cc. Narrower disturbances of all three kinds enter the spectra as the density is increased, probably due to increased coupling to acoustic disturbances and to greater convection and turbulence at higher vapor densities. It appears that the narrow disturbances are present at the lower vapor densities but at such low amplitude levels as not to disturb the arc. As the density is increased, the disturbances are amplified. Thus, even though miniature lamps may be operated at high densities, the resonance-free regions in the 20 to 50 KHz spectrum effectively narrow as the density is increased so that a practical upper density level for satisfactory performance is reached. My data indicate that in order to avoid an excess of narrower disturbances, the mercury density level for any size of miniature metal halide lamps should not exceed 100 mg/cm$^3$, and for a 6 mm i.d. bulb, it should not exceed 80 mg/cm$^3$. For lamps of 6 to 7 mm i.d., the preferred mercury vapor operating density from the point of view of obtaining wide stable operating bands or windows in the range from 20 to 50 KHz is from approximately 30 to 40 mg/cm$^3$.

Compact High Frequency Ballasts

The presence of the resonance-free bands which I have discovered allows miniature metal vapor lamps to be operated with compact, economical and efficient high frequency ballasting circuits in the desirable 20 to 50 kilohertz frequency range. Such circuits in general comprise a power oscillator with current limiting means coupled to a lamp. Typical circuits use solid state control devices and ferrite cores; they may be made compact enough for direct attachment to the lamp at the utilization point, that is at the electrical outlet or socket, or may be integrally joined to the lamp to make a so-called screw-in unit.

Figure 10:
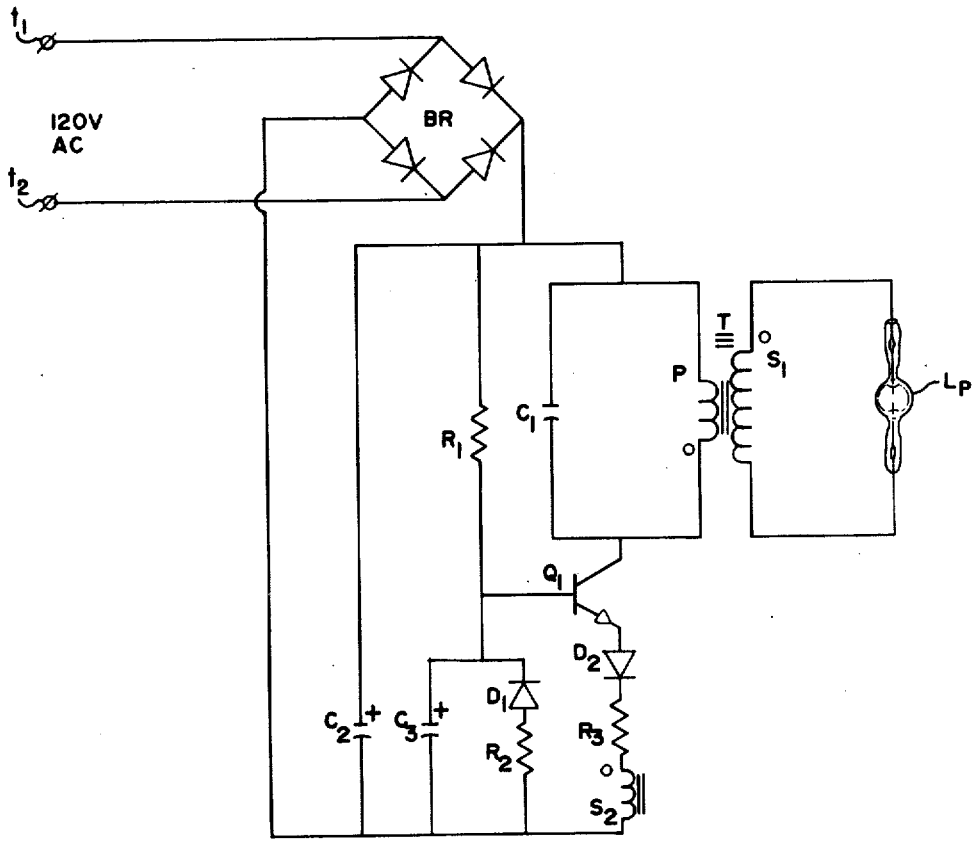
FIG. 10 is a schematic circuit diagram of a high frequency ballast using solid state components.

Referring to FIG. 10, an example of a compact high frequency ballasting circuit is illustrated in the form of a blocking oscillator. A full wave bridge rectifier BR connected across 120 v, 60 Hz line terminals $t_1$, $t_2$ provides rectified d.c. power to drive the inverter. Filter capacitator $C_2$ connected across the bridge's output terminal provides sufficient smoothing action to avoid reignition problems due to line frequency modulation of the high frequency output. A ferrite core transformer T has a primary winding P, a secondary high voltage winding $S_1$ across which the miniature lamp $L_p$ is connected, and a feedback winding $S_2$. The winding sense is conventionally indicated by a hollow point at the appropriate end of the windings. The primary winding P, the collector-emitter path of transistor $Q_1$, and the feedback winding $S_2$ all connected in series form the principal primary current path. In that path $R_3$ is a current limiting resistor and diode $D_2$ provides reverse current protection for transistor $Q_1$. Resistors $R_1$ and $R_2$, diode $D_1$ and capacitator $C_3$ provide base drive for this transistor.

The operation of the blocking oscillator may be summarized as follows: whenever the collector current is less than the gain times the drive of switching transistor $Q_1$, the transistor is saturated, and that is it is fully on and acts like a switch. The collector current then is limited by the inductance of the transformer windings P and $S_2$. As the collector current rises and approaches a value equal to the gain times the base current drive, the transistor begins to come out of saturation. This serves to reduce the voltage across $S_2$ which in turn reduces the base drive and through regenerative action turns transistor $Q_1$ off. Regeneration occurs after the field collapses in primary winding P. This returns the circuit to its initial condition so that the cycle may repeat, thereby providing a high frequency drive for the lamp connected across secondary winding $S_1$. The leakage reactance of transformer T serves to limit the discharge current through the lamp.

The foregoing is but one example of compact high frequency ballasting circuits which may readily be designed to operate above the audible frequency range and below the frequency range of excessive electromagnetic interference. Many other forms exist or may be designed from known circuits.

What I claim as new and desire to secure by Letters Patent is:

1. A method of operating a miniature high pressure metal vapor discharge lamp having a pair of electrodes and a discharge volume not exceeding approximately 1 cubic centimeter, which consists in applying an alternating voltage across said electrodes at a frequency in a resonance-free region located above 20 and below 50 kilohertz in order to be beyond the audible range but below the range of excessive electromagnetic interference.

2. The method of claim 1 wherein the resonance-free region in which the operating frequency is contained, is located between the first and second catastrophic instability bands.

3. The method of claim 1 wherein the operating frequency is located between the first and second catastrophic instability bands in a region clear of arc and aureole instabilities.

4. The method of claim 1 for operating a lamp of the stated kind which is spheroidal with an internal diameter of approximately 6 millimeters or less wherein the operating frequency is located above the audible range but below the first catastrophic instability band.

5. The method of claim 4 wherein the operating frequency is located in a region clear of arc and aureole instability.

6. The method of claim 1 for operating a lamp of the stated kind containing mercury and metal halide and which is spheroidal with an internal diameter between approximately 7 and 4 millimeters wherein the operating frequency is located in one of the stable windows 89, 90 and 93 of FIG. 8.

7. In combination, a miniature high pressure metal vapor lamp comprising an envelope defining a discharge volume not exceeding approximately 1 cubic centimeter and having a pair of electrodes sealed therein, and means for energizing said lamp comprising a source of alternating current connected across said electrodes, the frequency of said source being in a resonance-free region located above 20 and below 50 kilohertz in order to be beyond the audible range but below the range of excessive electromagnetic interference.

8. The combination of claim 7 wherein said source frequency is located between the first and second catastrophic instability bands.

9. The combination of claim 7 wherein said source frequency is located between the first and second catastrophic instability bands in regions clear of arc and aureole instabilities.

10. The combination of claim 7 wherein said lamp is spheroidal with an internal diameter of approximately 6 millimeters or less and wherein said source frequency is located above the audible range but below the first catastrophic instability band.

11. The combination of claim 10 wherein said source frequency is located in a region clear of arc and aureole instability.

12. In combination, a miniature high pressure metal vapor lamp comprising an envelope defining a generally spheroidal discharge space not exceeding approximately 1 cubic centimeter in volume, said envelope having a pair of electrodes sealed therein and containing an ionizable medium comprising metal halide and a quantity of mercury providing a density level during operation not exceeding 100 mg/cm$^3$, and means for energizing said lamp comprising a source of alternating current connected across said electrodes, the frequency of said source being in a resonance-free region of said lamp located above 20 and below 50 kilohertz.

13. The combination of claim 12 wherein said source frequency is located between the first and second catastrophic instability bands in a region clear of arc and aureole instabilities.

14. The combination of claim 12 wherein said lamp has an internal diameter of approximately 6 millimeters or less and wherein said source frequency is located above the audible range but below the first catastrophic instability band in a region clear of arc and aureole instability.

15. The combination of claim 12 wherein the quantity of mercury in said lamp provides a density level during operation not exceeding 80 mg/cm$^3$.

16. The combination of claim 12 wherein said lamp has an internal diameter between approximately 7 and 4 millimeters and wherein the frequency of said source is located in one of the stable windows 89, 90 and 93 of FIG. 8.

17. The combination of claim 12 whereing said source of alternating current is a power oscillator with current limiting means coupled to the lamp.

18. The combination of claim 12 wherein said lamp has an internal diameter between approximately 7 and 4 millimeters and wherein said source of alternating current is a power oscillator with current limiting means coupled to the lamp, said power oscillator operating at a frequency located in one of the stable windows 89, 90 and 93 of FIG. 8.

* * * * *